United States Patent [19]

Stigsson et al.

[11] Patent Number: 4,599,089

[45] Date of Patent: Jul. 8, 1986

[54] COAL-WATER DISPERSION

[75] Inventors: Lars L. Stigsson; Björn Lindman, both of Lund, Sweden

[73] Assignee: Fluidcarbon International AB, Malmö, Sweden

[21] Appl. No.: 704,586

[22] Filed: Feb. 22, 1985

Related U.S. Application Data

[63] Continuation-in-part of Ser. No. 480,959, Mar. 29, 1983, abandoned.

[51] Int. Cl.[4] ..... C10L 1/32

[52] U.S. Cl. ..... 44/51; 44/66; 260/403

[58] Field of Search ..... 44/51, 66; 406/47, 49, 406/197; 260/403

[56] References Cited

U.S. PATENT DOCUMENTS

| | | | |
|---|---|---|---|
| 3,069,361 | 12/1962 | Cogswell | 252/351 |
| 3,547,605 | 12/1970 | Cornelius, III et al. | 44/66 |
| 4,200,551 | 4/1980 | Orthoefer | 260/403 |
| 4,242,098 | 12/1980 | Braun et al. | 44/51 |
| 4,282,006 | 8/1981 | Funk | 44/51 |
| 4,358,293 | 11/1982 | Mark | 44/51 |
| 4,492,590 | 1/1985 | Schick et al. | 44/53 |

OTHER PUBLICATIONS

*Kirk-Othmer Encyclopedia of Chemical Technology,* 2nd ed., vol. 12, John Wiley & Sons, Inc., 1967, pp. 344,358.

Chemical Abstract 87:55532b, vol. 87, 1977.

Stigsson, Lars Lennart et al., PCT/SE82/00107, 4--5-82.

*Primary Examiner*—William R. Dixon, Jr.

*Assistant Examiner*—Margaret B. Medley

*Attorney, Agent, or Firm*—Berman, Aisenberg & Platt

[57] ABSTRACT

A storage stable aqueous pulverized-coal dispersion can be pumped and can be burned by conventional techniques. The dispersion comprises stabilizing additives and a coal content which ranges from 60 to 80% by weight. The additives include a combination of (a) sufficient lecithin adsorbed on surfaces of coal particles to provide repulsion between the coal particles by hydration forces and (b) polymer cooperating with the lecithin and comprising at least one polymer having segments of hydrophobic as well as segments of hydrophilic character.

24 Claims, No Drawings

COAL-WATER DISPERSION

This application is a continuation-in-part of application Ser. No. 480,959, filed on Mar. 29, 1983, and now abandoned.

The present invention relates to a coal-water dispersion which is very stable in storage and is suitable for transport and energy production. More particularly the invention relates to a dispersion comprising water, pulverized coal and additives, the coal content ranging from 60 to 80% by weight.

A dispersion of coal is considerably less polluting and can be more easily handled than solid coal and also eliminates some risks involved in transport and storage. Such a dispersion is also preferred from an economical point of view.

The reason for using coal dispersions is the planned increased use of coal as a basic energy source in large as well as small plants for producing electricity and heat. The handling of solid coal in this connection is difficult for several reasons and, therefore, the transformation of the coal to liquid form generally is considered an interesting method. Chemical conversion of coal to a liquid product, so-called liquefaction, still cannot compete with oil and it is considered that this method can contribute to the global energy provision only marginally before the year 2000. Chemical conversion of the coal to a gaseous product, so-called gasification, seems to be a more prosperous method of utilizing coal. However, also this method still involves considerable technical difficulties although large resources have been spent on technical development.

Physical conversion is another method of transforming the coal into liquid form, and the invention relates to this method. It is practised by dispersing the coal in a liquid which may consist of some organic fuel, such as heating oil, methanol, etc, or of water.

A low viscous dispersion of coal particles in water is often referred to as a coal-water slurry. A slurry with solids content of coal of more than about 60% by weight, pulverized to a suitable extent, and intended for use as a fuel, is often referred to as a coal-water fuel.

Substantially since the 1940's, coal-water slurries have been developed and evaluated primarily for coal transportation, usually with low contents of pulverized coal. The development of coal-water slurries during essentially the last decade, primarily has aimed at an increase of the coal content of the slurry, with at least unchanged or in many cases substantially improved flow properties and stability. An important feature of the recent development of the coal-water slurry is to optimize the rheological properties thereof for direct use (i.e. without dewatering, etc.) as a liquid fuel, especially as a substitute for heavy fuel oil.

Here good rheological characteristics of the slurry are of the outmost importance, for example by lowering the erosion in the supply systems and the burners and also by improving the efficiency of the so-called atomization process.

The general means of achieving said properties are to optimize the particle size distribution of the coal particles and, most important, to provide more efficient dispersant and stabilizer systems.

The fundamental problem of water dispersions of pulverized coal at high solids content, is to make the dispersion stable at low viscosity. The coal particles must not sediment during storage or transport of the coal dispersion. Moreover, the coal dispersion shall have a high pumpability and shall have rheological properties so as to be suitable for burning by conventional technique probably modified to a minor degree.

Among previous proposals of stabilizing coal-water dispersions the proposal could be mentioned, which is described in the Russian publication Khim. Pereab. Topl. 1975 30(2) 19–29, which is summarized in Chemical Abstracts 87: 55532b. In that case salts of polycarboxylic acid and polyphosphates are used among others as stabilizers. The viscosity of the optimal mixture is about 5 P at a coal content of 57 to 63%, and it follows thereof that this dispersion does not satisfy the demands. Moreover, the stability of sedimentation is deficient.

In the laid-open Swedish specification No. 7805632-2, a coal-water dispersion is disclosed wherein a stabilizing action against sedimentation is obtained by conventional polyelectrolytes, among them polyphosphate, according to the same principles as those described in the Russian publication mentioned above. Also in this case the stability against sedimentation is not satisfactory.

U.S. patent specification No. 4,242,098 describes a coal-water dispersion wherein the stabilization is obtained by the addition of a number of water soluble polymers (polyethyleneoxide, polyacrylamides, etc.).

U.S. patent specification No. 4,358,293 issued Nov. 9, 1982, reveals coal-water mixtures containing non-ionic high molecular weight surfactants with at least 100 repeating ethyleneoxide units in the hydrophilic portion, and also containing natural gums as stabilizing agents.

The two last-mentioned dispersions provide improvements in relation to the other dispersions mentioned above.

SUMMARY OF THE INVENTION

The invention is an aqueous pulverized-coal dispersion comprising stabilizing additives and wherein the coal content ranges from 60 to 80% by weight. The additives include a combination of (a) sufficient lecithin, e.g. zwitterionic lecithin, adsorbed on surfaces of coal particles to provide repulsion between the coal particles by hydration forces and (b) polymer cooperating with the lecithin and comprising at least one polymer having segments of hydrophobic as well as segments of hydrophilic character. The segments of hydrophobic character are, e.g., those of polypropyleneoxide, of alkyl groups, of alkylaryl groups or of a combination of any of the preceding, whereas the segments of hydrophilic character are, e.g., those of polyethyleneoxide with at least twenty ethylene oxide units.

A suitable cationic polymer is one having an amine, alkylamine or quaternary amine function, e.g. a quaternary alkylaminated polyalkoxide adduct. A suitable anionic polymer contains a group, such as carboxylate, sulphonate, sulphate or phosphate, e.g. a sulphonated alkylarylpolyalkyleneoxide. The polymer is optionally amphoteric, including a true zwitterionic substance.

The polymer is, e.g., a copolymer of polyethyleneoxide and polypropyleneoxide with a dominating amount of polyethyleneoxide (e.g. a copolymer of at least 70% by weight of polyethyleneoxide having a molecular weight within the range of from 8,000 to 15,000) or an alkylaryl polypropylene oxide. The molecular weight of the copolymer ranges, e.g., from 5,000 to 50,000.

The amount of lecithin can range from 0.01 to 0.6% by weight and is advantageously in the range of from 0.03 to 0.2% by weight.

The total amount of additives in the dispersion is advantageously below 2% by weight, e.g. in the range of from 0.1 to 1% by weight.

In the terminology currently used for particulate dispersions, the concept of stabilization has two different meanings, i.e. it may be used to signify either the process of (i) deflocculation of the particles to be dispersed, or the process of (ii) counteracting particle sedimentation.

The term stabilization as used herein, refers to both functions.

As stated above, the fundamental demand on an additive system for a coal-water dispersion, is that it renders the dispersion a low viscosity, i.e. it shall strongly reduce the friction between the coal particles. This is obtained by various means such as electrostatic and steric stabilization or stabilization by hydration forces, as is described further below.

At the same time, it is important to counteract sedimentation of the coal particles, which generally have a higher density than water. This stabilization against sedimentation may be obtained by various additives, often referred to as thickeners, since they always cause an increase in dispersion viscosity.

The dispersing additives of this invention comprise the use of different types of commercial lecithin (as soy, rape seed, or plant lecithin), or purified zwitterionic lecithin, in combination with high molecular weight (i.e. polymeric) surfactants from all surfactant classes (i.e. nonionic, anionic, cationic and amphoteric (including true zwitterionic)). Here the lecithins provide repulsion by hydration forces, the effect of which is very favourably combined with steric hindrance repulsion from the hydrophilic portion of the polymeric surfactant. Furthermore, in the cases of the slightly charged polymeric additives mentioned above, also electrostatic repulsion contributes in dispersing the coal particles.

The hydrophilic portion of the polymeric surfactant additive preferably should contain at least one polyethyleneoxide chain with at least 20 ethyleneoxide units. The hydrophobic portion of the polymer may typically contain polypropyleneoxide or various hydrocarbon groups, or combinations of these two. Such hydrocarbons may be alkylaryls such as the alkylnaphtyl or alkylphenyl groups.

Examples of substances giving a pronounced stabilization against sedimentation, are found in the group comprising natural gums (xanthan gum, guar gum, locust bean gum, etc), polysaccharides like alginates, modified starch, etc, modified cellulose, synthetic polyelectrolytes like modified polyacrylate, or various clays (Attapulgite, Bentonite, Chinese clay, etc.).

Lecithin has been used for a considerable time; commercial production started in the 1930's. Kirk-Othmer in the "Encyclopedia of Chemical Technology", 1969, vol. 12, pp. 343–361, gives a good resumee of the state of the art on the predominant uses of lecithin as an emulsifier, i.e. as a dispersant in the formation of emulsions of immiscible liquids. Lecithin is valued for its softening, detersive, antioxidant, and physiological properties, especially in the food and pharmaceutical industries. Lecithin may also be used in dispersions of particles in (primarily organophilic) liquids. As an example of such industrial applications of lecithin, one may mention what is revealed in U.S. Pat. No. 3,068,111 to Seymour and Snyder, where lecithin is used as one of the dispersants for paint colorant and tinting compositions, containing up to 50% pigments. Here lecithin is used in concentrations of 4–5% by weight. Colorants which were prepared in our laboratory according to the recipes in examples I and VII in said patent, were pastes and not free-flowing slurries, and there were marginal differences in viscosity when the compositions were made with or without lecithin. The function of the very high lecithin concentrations used according to said patent, obviously is to make the pigments in the pastes compatible with the organophilic vehicle in paints.

Another example is given in U.S. Pat. No. 3,547,605 to Cornelius & Bischof, where lecithin added to a dispersion of metal oxides in oil with fatty acid as dispersant, enhances the stability of the dispersion. The described metal oxide dispersion is used to prevent corrosion and slag depositions in heat exchangers, when burned together with primarily fuel oil, but also in burning gaseous or solid fuels.

The inventors are not aware of any cases wherein lecithin is used as a dispersant when an extensive liquid or semisolid organic phase is not an important constituent of the composition, or wherein lecithin is used in an intermediary composition not intended for use together with organophilic or hydrophobic substances. More explicitly, to the knowledge of the inventors there have been no reports on the use of lecithin as a dispersant for coal-water fuels.

One of the normal, fundamental requirements for a dispersant especially when used for particles in liquids, is that the dispersant must be soluble in the liquid medium (see e.g. "Emulsions, Latices, and Dispersions", Marcel Dekker, Inc., 1978, p 8). Therefore, lecithin as a surface active agent insoluble in water, is not expected to be a good dispersant in dispersions where the continuous phase is water.

Consequently, lecithin certainly is not expected, by those skilled in the art of making aqueous dispersions of pulverized coal, to be an effective dispersant in this system or in similar systems. Indeed, lecithin does not function as a dispersant per se, for pulverized coal in water.

The main object of the present invention is to provide a coal-water slurry having additive compositions comprising dispersing and stabilizing agents, which provide a low viscosity of the coal-water slurry and improved properties of the slurry as compared to prior art slurries.

Another object of the invention is to provide a coal-water slurry to be used as a fuel, having a higher solids content than prior art coal-water fuels.

A further object of the invention is to provide a coal-water slurry for direct use as a liquid fuel, having improved rheological properties.

According to the invention these and other objects are achieved by a coal-water slurry comprising water, pulverized coal and additives, the coal content ranging from 60 to 80% by weight, the dispersion containing (a) lecithin which adsorbs on surfaces of coal particles and provides repulsion between the coal particles by hydration forces and (b) polymer cooperating with said lecithin and comprising at least one polymer containing segments of hydrophobic as well as of hydrophilic character.

By the combined use of lecithin and polymeric surfactants a very strong reduction in viscosity of the coal-water slurry is obtained, which is most unexpected from the prior art as demonstrated by known uses of lecithin in systems of other types, and by the known use of polymeric surfactants alone in coal-water slurries.

The lecithin may be incorporated in to the slurry as pure lecithin, but for ease of handling and in order to facilitate the distribution to the coal surface, it is preferably added as an aqueous emulsion or dissolved in an organic solvent.

There are several methods of obtaining lecithin-water emulsions; one may simply use high intensity stirring of a lecithin and water mixture or combine stirring with ultrasonic mixing. Furthermore, there are several methods of producing stabilized lecithin-water emulsions with the aid of various dispersants, for example as described in U.S. Pat. No. 3,069,361 to Cogswell, or in U.S. Pat. No. 4,200,551 to Orthoefer.

The theory of the stability of dispersions has recently been considerably refined. The theory has been developed to include more concentrated systems but above all a new type of interaction has been proved. In addition to previously known effects, such as electrostatic stabilization by means of charged surface-active substances and polyelectrolytes and sterical stabilization by means of polymers, there is a further central effect: so-called hydration forces. These forces have recently been proved and have also been explained theoretically.

From studies of lamellar liquid crystalline phases in systems of ionic surface-active substances it has been shown that these phases can swell and incorporate large amounts of water. This is explained by a repulsion over the water layer between adjacent layers of surface-active substance and can be related to electrostatic double-layer forces. For zwitterionic substances, such as the phospholipid lecithin, the swelling is less pronounced but nevertheless very clear. This shows that also in the absence of a net charge there is a considerable repulsion. This repulsion force, the so-called hydration force, is varying approximately exponentially with the distance with a declination over 2–3 Angstrom. The force is of a general character and does not vary with the length of the alkyl chain or with the physical condition of the chains (liquid or solid) and is present also when an amount of charged surface-active substance is included into the system. Hydration forces have been proved also by measuring directly the forces between surfaces mutually spaced some Angstrom. A theoretical model for hydration forces has recently been developed, and then it has been possible to relate these forces to the presence of so-called mirror charges over interfaces where the effective dielectric constant is being changed. Such mirror charges with zwitterionic groups should be common in micro- and macro-heterogeneous systems. They are utilized according to this invention in order to impart desired properties to a suspension of coal particles in water. Then, a zwitterionic surface-active substance, such as lecithin, can be adsorbed onto the surfaces of the coal particles. Strong repulsion forces between the particles then exist at short distances. The principle therefore will be particularly useful for concentrated dispersions.

In the coal-water slurry of the invention an important portion of the viscosity reduction and the deflocculation stabilization is brought about by the adsorption of the hydrophobic portion of the polymer onto the coal surface while the hydrophilic portion gives the diffuse so-called steric hindrance repulsion (in the case of a non-ionic polymer) or a combination of steric hindrance and electrostatic repulsion (in the cases of polymers having a low charge). The hydration force brought about by the partial surface coverage with lecithin gives an additional strong repulsion at very short interparticle distances. To obtain a balanced combination of these two fundamentally different repulsion forces, it is important not to allow the lecithin concentration to be too high; lecithin binds more efficiently to the coal surface than most polymers and an excessive addition therefore will preclude the binding of polymers with a very poor resulting slurry. It is certainly not advisable to use more than up to about 0.5% lecithin in a coal-water slurry and typical dosages range from 0.02 to 0.15% by weight of the slurry.

The combination of steric hindrance, and, in some cases, a weak electrostatic repulsion, with the hydration repulsion force is of especially great importance when the slurry is under high shear stress, i.e. this combination provides good flow properties at very high transportation rates, in pumps and in various burner configurations.

Since the interparticle and intermolecular forces in the composition of pulverized coal, water, and additives, are almost impossible to fully describe theoretically, applicants do not assert that the explanation of the effect of the combined use of the polymers and lecithin as dispersant in the slurry completely exhausts the possibilities of theoretical explanations.

One possible effect of the addition of lecithin is that a small portion of the added lecithin may act as a hydrophobizer of hydrophilic sites on the coal surface.

Another more speculative effect is that lecithin effectively may replace water in pores on the coal surface, thereby freeing more water and therefore giving a possibility for a higher content of solids in the slurry.

The inventors have observed also other effects in the use of lecithin in the slurry, which cannot be explained by hydration forces. One important example is that lecithin acts as a defoamer in the slurry. This is an important benefit, since it strongly reduces the amount of entrapped air in the slurry and therefore gives a much higher density. A low foaming tendency and a low content of enclosed air in the slurry furthermore are of great importance in slurry pumping (esp. on the suction side.).

The invention will be described in more detail by the examples below.

The coal preparation processes, prior to making the coal-water slurry, comprise (in preferably wet processes) coal crushing, grinding and sieving to suitable particle size distribution and, when beneficial, a coal cleaning procedure aimed to reduce mineral matter such as clay, pyrite, etc, in the wet pulverized coal. Suitable size distributions of coal particles range from essentially 1 μm to about 300 μm with a broad size distribution (polydisperse coal particles). Often particle sizes below 200 μm are preferred, and particle sizes below 150 μm are most preferred.

The pulverized and cleaned coal may finally, before the slurry mixing step, be dewatered to a suitable degree (for example 75–85% solids content), e.g. in a conventional vacuum drum filter. The moisty product is usually named filter cake.

EXAMPLE 1

A non-micelle-forming zwitterionic surfactant such as lecithin which is relatively difficult to dissolve in water, is first dissolved in an organic solvent. The solvent can consist of for example octanol, hexadecane or methanol and can be recovered in a suitable manner or can comprise an insignificant portion by weight of the dispersion.

The surfactant preparation is added to pulverized coal and water. Suitable fractions of the coal powder range from 1 to 200 μm (preferably 150 μm) with a broad size distribution (polydispersed coal powder). The particle size and the size distribution can be chosen according to the desired stability. The smaller particle size, the greater stability but it is expensive to grind coal down to submicron particle sizes. The particle concentration can be varied within a broad range. Considering economical and technical aspects the particle concentration should be optimized from one case to the other. Coal-water dispersions with a dry substance content between 65 and 75% by weight are of particular interest because these dispersions have good rheological properties for example for transport in pipelines. In order to obtain the highest coal contents (70–80% by weight) the size distribution must be particularly taken into account. In the normal case this can be done on the basis of simple geometrical considerations as to the minimization of the free volume when packing particles of different sizes.

After the adsorption process two or more of polymeric surfactants and hydrophilic anionic and non-ionic polymers are added in order to provide some form of a steric barrier and in order to reduce the friction between the particles. For example one can choose between polyethers, polysaccarides, polyalcohols and polyacrylates. Particularly suitable according to the invention are polyethyleneoxide, copolymers of the polyethyleneoxide-polypropyleneoxide type, carboxymethylcellulose, and xanthan gum. The concentration of polymers in percent by weight, based on the total weight can be varied between 0.1 and 5% but is economically optimal in the range of from 0.6% to 4.0%.

Slurries prepared with polymeric surfactants from all surfactant classes mentioned above are compiled in the table below. For comparison, dispersions without lecithin were also produced, in order to demonstrate the important decrease in viscosity when lecithin is being used.

TABLE I

| Polymeric additive | Polymeric surfactants from all surfactant classes. Characterizing group | Surfactant class of polymer | Additive conc % | Viscosity* (cP) Without Lec. | Viscosity* (cP) With 0.05% Lec. |
|---|---|---|---|---|---|
| Polypropylene-oxide-polyethyleneoxide copolymer | —OH | Non-ionic | 0.4 | 1200 | 350 |
| Alkylphenyl-poly-alkylene-oxide | —OH | Non-ionic | 0.35 | 1350 | 450 |
| Sulphonated alkyl-arylpoly-alkylene-oxide | $—OSO_3^-$ | Anionic | 0.5 | 1100 | 300 |
| Quaternary alkylaminated poly-alkoxide adduct | $RN(R_2)_2—R_3^+$ | Cationic | 0.5 | 1610 | 430 |
| Aromatic polyethyleneoxide adduct | Tauride | Zwitterionic (Amphoteric) | 0.4 | 1120 | 240 |

*Viscosities are measured with a Brookfield Viscometer at 50 rpm, spindle 5.

Thus, in slurries containing lecithin and surface-active polymers from all surfactant classes a dramatic decrease in viscosity is observed as compared to dispersions without lecithin. The invention therefore enables stabilization to one month or more with acceptably low viscosity.

For the purpose of making the dispersion more attractive as a non-polluting substitute for oil some alkali salts or salts of the alkaline earths can be added to the dispersion. Preferably, the salt is calcium hydroxide or dolomite powder. The salt neutralizes acidic gas components generated at the oxidation of the fuel and can be recovered in a particle percipitator.

In order to prevent the water from evaporating from the coal-water dispersion an agent can be added to the dispersion which forms a monomolecular layer in the interface. Such an agent is cetyl alcohol (hexadecanol).

EXAMPLE 2

One typical procedure of producing coal-water slurry comprises mixing 250 parts of moist coal filtercake (containing 10–25% water) with 2–20 parts of an aqueous solution of a suitable polymeric surfactant (e.g., with 15% active ingredient) and 0.5–5 parts of an aqueous lecithin emulsion (containing e.g., 15% lecithin). In cases where a slurry with long term stability against sedimentation is desired, it is suitable to add 0.2–1 part of a paste of xanthan gum (with e.g. 12% active ingredient) or another comparable stabilizer.

After addition of 25–50 parts of water up to a total of 300 parts of the ingredients, and stirring for about 10 minutes at 600 rpm in a propeller mixer, a coal-water slurry is produced. In percent by weight such slurries are composed of about 65 to 75% coal, 0.1 to 1.0% polymeric additive, 0.02 to 0.2% lecithin, 0.01 to 0.04% stabilizer and a balance of water. Slurries with compositions outside these ranges can be produced by further varying the relative amount of constituents or additive concentrations.

For a wide variety of commercial coals, and with a proper choice of additives according to this invention, the resulting slurries have the properties desired of a liquid fuel, especially to replace fuel oil, i.e. in essence a high calorific value, a good stability at low viscosity, an excellent pumpability, and a facile atomization in various burners. Examples of slurry compositions and viscosities for 7 slurries containing pulverized coal from different sources are given in Table II below.

All dispersions contain a total of 0.6% or less of additives and have a coal content as indicated in the table. Viscosities are given for a dispersion with the given lecithin concentrations and also for comparable dispersions without lecithin.

TABLE II

Slurry from various coals.

| Coal name | Solids content (% wt) | Lecithin (% wt) | Viscosity* (cP) | Viscosity* (cP) Without lecithin |
|---|---|---|---|---|
| Montcoal Coal | 71 | 0.05 | 600 | ca 1600 |
| Wellmore Coal | 72 | 0.05 | 820 | NP** |
| Polish Std Coal | 66 | 0.10 | 380 | ca 1650 |
| Spitzbergen Coal | 68 | 0.05 | ca 1200 | NP** |
| German Ruhr Coal | 66 | 0.10 | 1180 | NP** |
| Dehue Coal | 68 | 0.10 | 680 | NP** |
| Czechish Std Coal | 70 | 0.005 | 360 | 960 |

*Viscosities are all measured with Brookfield Viscometer at 50 rpm with spindle 5.
**NP indicates non-pourable pastes with viscosities greater or much greater than 3000 cp.

The results show that the dispersions produced without lecithin in many cases are non-pourable pastes, and that they in all cases have at least 2- to 3-fold higher viscosities than dispersions produced in accordance with this invention. Slurries with lecithin of all presented coals can be stabilized in accordance with our recipe, at viscosities below 2000 cP, which has been found to be a suitable limit for slurries to be burned in for example a Rotary Cup burner.

EXAMPLE 3

To produce a pourable mixture of pulverized coal and water without additives, one has to use quite a low proportion of coal. For a coal type that very easily gives a low viscous dispersion at a coal content of 75% with proper dispersing agents, already 60% coal/40% water gives high viscosity (and unacceptable rheological properties in other respects). For such a coal type, dispersions with 55% and 60% coal in water were prepared, and the effect on the viscosity of various concentrations of soy bean lecithin added to the dispersion was studied. For comparison, dispersions with 0.10% polymeric dispersant were also produced in the case of 60% coal.

TABLE III

Effect of Lecithin in Coal-Water Mixtures.

| Lecithin conc. (% wt) | Viscosity (cP) 55% Coal Without polymer | 60% Coal Without polymer | 0.1% polymer |
|---|---|---|---|
| 0.00 | 1020 | 1980 | 1092 |
| 0.05 | 1580 | 2250 | 780 |

TABLE III-continued

Effect of Lecithin in Coal-Water Mixtures.

| Lecithin conc. (% wt) | Viscosity (cP) 55% Coal Without polymer | 60% Coal Without polymer | 0.1% polymer |
|---|---|---|---|
| 0.10 | 1690 | 8000 | 580 |
| 0.2 | 2560 | — | 280 |
| 0.4 | 4000 | ca 40000 | 340 |
| 1.2 | — | — | 1200 |
| 2.0 | 6500 | ca 64000 | — |

Lecithin clearly does not function as an effective dispersant when used alone in coal-water dispersions; on the contrary, it worsens considerably the rheological properties. For these low coal content dispersions already 0.1% of a polymeric dispersant gives very low viscosities when used together with suitable amounts of lecithin.

EXAMPLE 4

The effect on slurry viscosity of various concentrations of lecithin in coal-water slurries have been investigated. Slurries were produced as described in Example 2.

TABLE IV

Effect of Lecithin Concentration.

| Slurry compositions: | Czechish Coal | German Ruhr Coal |
|---|---|---|
| Pulverized coal | 70% | 65% |
| Non-ionic polymeric additive | 0.3% | 0.5% |
| Lecithin (Rape Seed) | 0.0–2.0% | 0–0.8% |
| Water | Balance | Balance |
| | 100% | 100% |

| Coal | Lecithin in slurry % wt | Viscosity cP | Flocculation |
|---|---|---|---|
| Czechish | 0.00 | 875 | slight |
| | 0.01 | 490 | none |
| | 0.015 | 490 | " |
| | 0.02 | 470 | " |
| | 0.035 | 415 | " |
| | 0.05 | 350 | " |
| | 0.07 | 304 | " |
| | 0.15 | 290 | " |
| | 0.35 | 290 | " |
| | 0.70 | 1280 | slight |
| | 1.05 | ca 3000 | strong |
| | 2.00 | NP* | paste |
| German Ruhr | 0.00 | 1760 | intermediate |
| | 0.025 | 1070 | slight |
| | 0.05 | 880 | " |
| | 0.10 | 650 | none |
| | 0.20 | 780 | " |
| | 0.30 | 630 | " |
| | 0.40 | 550 | " |
| | 0.80 | 880 | slight |

*NP indicates a non-pourable paste

Here, especially for the Czechish coal, already at very low lecithin concentrations, a substantial lowering of viscosity is observed. At high dosages of lecithin, however, pronounced flocculation is observed accompanied by increases in viscosity.

The German coal, having a less hydrophobic coal surface, requires higher amounts of lecithin to acquire maximum effect. Also in this case, overdosage causes flocculation and thus higher slurry viscosity.

EXAMPLE 5

Coal-water slurries of pulverized Czechish coal were produced according to Example 2, with coal contents from 69 up to 76% by weight of the slurries. As the polymeric dispersant the non-ionic surfactant Pluronic F127 (BASF Inc.) was used at a concentration of 0.4%-wt. Lecithin was used in the concentrations 0.00, 0.05, and 0.10% by weight. Viscosities of the resulting dispersions are given in Table V, where also viscosities for slurries produced in the same manner and with the same additive composition for Dehue coal are included.

TABLE V

Effect of Coal Concentration.

| Coal concentration (% wt) | Viscosity (cP)*** No lecithin | 0.05% lecithin | 0.10% lecithin |
|---|---|---|---|
| Czechish | | | |
| 69 | 720 | 440 | 344 |
| 70 | 880 | 464 | 400 |
| 72 | 1800 | 640 | 512 |
| 74 | 3400 PL* | 920 | 584 |
| 75 | >4000 NP** | — | 1080 |
| 76 | >>6000 NP | 2160 | 1560 |
| Dehue Coal | | | |
| 64 | 560 | 265 | 240 |
| 66 | 3600 PL | 640 | 520 |
| 68 | >5000 NP | 1720 | 1200 |

*PL indicates the upper limit in viscosity where a dispersion is a free flowing slurry.
**NP indicates a non-pourable paste.
***Viscosities are measured with a Brookfield Viscometer at 50 rpm with spindle 5.

These results show that the improvements offered by the present art, as compared to the use of polymers without lecithin, are especially pronounced at high solids content in the slurries. Thus, the present invention permits a considerable increase of the coal content in the slurry.

EXAMPLE 6

Slurries produced with and without lecithin for example as presented in the above examples, show very different behaviour. This is true also for coal-water slurries produced, for example, according to Example 1 or 2, with different concentrations of polymeric dispersant. For dispersions with compositions as described below, resulting viscosities are given in table VI.

| Composition: | Slurry A | Slurry B |
|---|---|---|
| Pulverized coal | 70% wt Czechish | 70% wt Montcoal |
| Polymeric surfactant | 0.1%-1.0% wt non-ionic | 0.1-1.0% wt zwitterionic |
| Lecithin | 0 or 0.05% wt Soy lecithin | 0 or 0.05% wt Soy lecithin |
| Water | Balance | Balance |
| | 100% | 100% |

TABLE VI

Effect of Polymeric Dispersant Concentration.

| Polymer concentration % wt | Viscosity (cP) No lecithin | 0.05% lecithin |
|---|---|---|
| Slurry A | | |
| 0.10 | >>8000 NP | ca 3500 PL |
| 0.16 | 2700 | 1200 |
| 0.18 | — | 720 |
| 0.20 | 1920 | 540 |
| 0.30 | 1080 | 480 |
| 0.40 | 860 | 460 |
| 0.50 | 850 | 328 |
| 0.65 | 960 | 296 |
| 0.80 | 1440 | 320 |
| 1.00 | ca 3000 PL | 320 |

TABLE VI-continued

Effect of Polymeric Dispersant Concentration.

| Polymer concentration % wt | Viscosity (cP) No lecithin | 0.05% lecithin |
|---|---|---|
| Slurry B | | |
| 0.15 | NP | 2700 |
| 0.20 | 2700 | 620 |
| 0.30 | 1000 | 490 |
| 0.40 | 880 | 416 |
| 0.50 | 1020 | 270 |
| 0.60 | 960 | 260 |
| 0.80 | 1180 | 310 |
| 1.00 | 1100 | 330 |

For slurries containing the non-ionic polymeric additive, produced according to prior art (i.e. without lecithin), a typical minimum in viscosity is observed, such that with increasing polymer concentration first a decreasing viscosity results and thereafter increasing viscosities occur. Already with 0.05% lecithin in the dispersion much lower viscosities are observed, and the increase in viscosity at high polymer dosages has almost disappeared.

The same is true when a zwitterionic polymeric dispersant is used, but here the increase in viscosity at polymer overdosage is less pronounced already without added lecithin. An explanation to this might be that the zwitterionic component in the polymer gives enough repulsion by hydration forces to resemble the function of lecithin.

EXAMPLE 7

A disadvantage in slurries without lecithin is, apart from too high viscosities at high solids loading of pulverized coal, that they have a low density due to entrapped air, and thus a high foaming tendency.

We have found that lecithin incorporated in the coal-water dispersions, besides its main function, also acts as an effective defoamer, i.e. to a very high extent reduces the air entrained in the dispersion. See the results in the table below for slurries of German Ruhr Coal with a non-ionic polymeric dispersant and varying concentrations of lecithin.

TABLE VII

Lecithin as Defoamer in Coal-Water Slurry.

| Lecithin content % wt | Viscosity cP | Density Absolute tons/m$^3$ | Relative to theoretical max |
|---|---|---|---|
| 0.00 | 3400 | 0.94 | 75% |
| 0.05 | 1290 | 1.18 | 94% |
| 0.10 | 896 | 1.20 | 96% |

Thus apart from giving vastly improved flow properties, the present art also provides slurries with much higher density. This is of great importance in pumping and otherwise transporting or handling coal-water fuels.

EXAMPLE 8

The fundamental demands on a coal-water fuel is that it is pumpable and possible to atomize in suitable burners. The first requirement is therefore a fuel with low viscosity, where a limit of about 2000 cP (Brookfield spindle 5, 50 rpm) has been found to be appropriate. For high solids content slurries it has according to the prior art been difficult to come below this viscosity limit for slurries stabilized to 1 month or more (static and dynamic sedimentation stability). Using additive compositions according to this invention enables proper stabilization at low viscosities due to the much lower starting viscosities of the unstabilized dispersions.

This is shown below for a slurry containing 70%-wt of pulverized Montcoal and 0.04%-wt non-ionic polymeric dispersant (Pluriol PE 10500, BASF AG).

TABLE VIII

| Added Thickener (Xanthan gum, Kelco) % wt | Sedimentation Stability Viscosity*** (cP) 0.00% | 0.05% lecithin | 0.10% | Stability against sedimentation |
|---|---|---|---|---|
| 0.000 | 960 | 390 | 340 | ca 1 week |
| 0.008 | 1800 | — | 440 | ca 1.5 weeks |
| 0.016 | 3200 PL* | — | — | ca 2 weeks |
| 0.040 | 10000 NP** | 1890 | 1675 | >1 month |

*Pourability limit
**Non-pourable paste
***Viscosities obtained with a Brookfield Viscometer at 50 rpm, spindle 5.

A characteristic rheological property of the coal-water slurries according to our invention as shown above, is that they are shear thinning (i.e. pseudoplastic rheology). When stabilized against sedimentation the slurries acquire a strongly increased pseudoplastic yield value and also highly improved shear thinning at high shear rates, as is shown in the table below for the slurry containing 0.1% lecithin as presented in Table VIII.

TABLE IX

| Shear rate ($s^{-1}$) | Slurry Rheology Viscosity* (cP) Unstabilized | Stabilized against sedimentation |
|---|---|---|
| 5 | 1200 | 3600 |
| 10 | 1050 | 2400 |
| 50 | 600 | 1500 |
| 100 | 420 | 1350 |

*Viscosities are measured by a HAAKE Rheoviscometer III, Mv II and III.

EXAMPLE 9

The use of lecithin together with polymeric surfactants in a coal-water slurry is especially effective when the polymeric dispersant contains one or more polyethyleneoxide chains. In Table X, viscosities in slurries produced according to this invention, and also without lecithin for comparison, are given. As the polymeric surfactant we have used polymers with very similar hydrophobic portions (alkyl phenyls) but with varying poly-ethylene oxide chain length.

TABLE X

| No of Ethylene-oxide units | Coal % wt | Effect of Ethyleneoxide Chain Length. Slurry Viscosity 0.00% lecithin | 0.05% lecithin |
|---|---|---|---|
| 20 | 67 | NP | 816 |
| 30 | 67 | NP | 316 |
| | 70 | NP | 1000 |
| 40 | 67 | 752 | 312 |
| | 70 | NP | 504 |
| 49 | 67 | 690 | 280 |
| | 70 | 1600 | 504 |
| 80 | 70 | 1040 | 432 |
| 90 | 70 | 1160 | 528 |
| 100 | 70 | 840 | 290 |
| 150 | 70 | 1016 | 360 |

The resulting slurries containing lecithin can all be stabilized to desired sedimentation stability with acceptable viscosity.

EXAMPLE 10

In pumping a coal-water fuel the pressure drop varies strongly with the slurry quality. Additions of lecithin give substantially lower pressure drops at all slurry flows investigated, as shown in Table XI for pumping coal-water fuel through a 2 meter long ½" wide tube connected to a rotary cup burner.

| | |
|---|---|
| Slurry composition: | |
| Coal: Pulverized Polish Std Coal | 67% wt |
| Additives: Dispersant slightly anionic polymer | 0.4% wt |
| Lecithin | 0, 0.05, or 0.10% wt |
| Water | Balance |
| | 100% wt |

TABLE XI

| Slurry flow (1/h) | Pressure Drop in Slurry Pumping Pressure drop, p (Bar) % Lecithin 0.00 | 0.05 | 0.10 |
|---|---|---|---|
| 160 | 1.0 | 0.5 | 0.4 |
| 288 | 2.0 | 1.2 | 1.1 |
| 420 | 3.0 | 1.9 | 1.6 |
| 600 | * | 2.7 | 2.5 |
| 760 | * | 3.5 | 3.2 |

*Reliable measurements not possible due to slurry cavitation in the pump.

For the slurry produced without lecithin high pumping pressure was required to obtain the required slurry flows. Furthermore, due to the above mentioned foaming tendency in slurries without lecithin, cavitation occurred (on the pump suction side) at high slurry flow. For the slurries made according to the present invention (as compared to slurries without lecithin) the energy consumption for pumping was cut to approximately half at the same slurry flow.

EXAMPLE 11

The efficiency of slurry atomization in a burner is strongly dependent on slurry rheology. The importance of having as low viscosity as possible is shown by the following results, obtained on commercial slurry, produced according to Example 2 of this invention.

TABLE XII

| Slurry Viscosity (cP) | Atomization Efficiency* | Carbon Burnout** |
|---|---|---|
| 448 | 51 | 96 |
| 264 | 56 | 97.5 |
| 128 | 60.5 | 98 |

*The atomization efficiency is defined as the % wt slurry droplets below the size 84.5 um in a slurry spray.
**The carbon burnout is defined as the burned % wt of the total coal content in a slurry when burned in a slurry burner at 6% excess oxygen.

As can be seen in the table, decreasing viscosity gives increased atomization efficiency, which in turn, is reflected in an increased carbon burnout efficiency.

The results presented in the examples above may be summarized as follows: The strongly improved flow properties of slurries with the combined use of lecithin and polymers as dispersant may be used in three major ways:

Reduction of additive costs due to a strongly decreased use of polymer at a certain coal concentration.

Production of slurries with higher coal content.

Many more coal qualities become accessible for slurry production at acceptable solids loadings.

The invention provides substantial advantages over the prior art technique of stabilizing coal particles in a water solution. Due to an excellent sedimentation stability combined with favourable rheological properties for pumping, the dispersion obtained is well suited for transporting coal in an appropriate manner in conduits of pipelines for use for example in the chemical industry or for direct energy production.

Combustion tests in boilers designed for heavy oil have shown that the dispersion is very suitable to replace oil completely or partly.

We claim:

1. A dispersion comprising water, pulverized coal and stabilizing additives, the coal content ranging from 60 to 80% by weight and the additives comprising a combination of (a) sufficient lecithin adsorbed on surfaces of coal particles to provide repulsion between the coal particles by hydration forces and (b) polymer cooperating with said lecithin and comprising at least one polymer having segments of hydrophobic as well as segments of hydrophilic character.

2. A dispersion as claimed in claim 1, wherein the lecithin is zwitterionic.

3. A dispersion as claimed in claim 1, wherein said segments of hydrophobic character are selected from the group consisting of those of polypropylene oxide, of alkyl groups, of alkylaryl groups and of combinations thereof, and wherein said segments of hydrophilic character are those of polyethylene oxide with at least 20 ethylene oxide units.

4. A dispersion as claimed in claim 3, wherein said one polymer is nonionic.

5. A dispersion as claimed in claim 4, wherein the copolymer contains at least 70% by weight of polyethylene oxide and has a molecular weight in the range of from 8,000 to 15,000.

6. A dispersion as claimed in claim 5, wherein said one polymer contains at least the groups including amine, alkylamine and quaternary amine.

7. A dispersion as claimed in claim 6, wherein said one polymer is a quaternary alkylaminated polyalkoxide adduct.

8. A dispersion as claimed in claim 3, wherein said one polymer is anionic.

9. A dispersion as claimed in claim 8, wherein said one polymer contains at least one of the groups including carboxylate, sulphonate, sulphate and phosphate.

10. A dispersion as claimed in claim 9, wherein said one polymer is a sulphonated alkylarylpolyalkyleneoxide.

11. A dispersion as claimed in claim 3, wherein said one polymer is amphoteric including a true zwitterionic substance.

12. A dispersion as claimed in claim 11, wherein said one polymer contains tauride.

13. A dispersion as claimed in claim 1, wherein said one polymer is a copolymer of polyethylene oxide and oxide polypropylene with a dominating amount of polyethylene oxide.

14. A dispersion as claimed in claim 13, wherein the molecular weight of the copolymer ranges from 5,000 to 50,000.

15. A dispersion as claimed in claim 14, wherein the copolymer contains at least 70% by weight of polyethyleneoxide and the molecular weight ranges from 8,000 to 15,000.

16. A dispersion as claimed in claim 1, wherein the amount of lecithin is in the range from 0.01 to 0.6% by weight.

17. A dispersion as claimed in claim 16, wherein the amount of lecithin is in the range from 0.03 to 0.2% by weight.

18. A dispersion as claimed in claim 17, wherein the amount of lecithin is about 0.05% by weight.

19. A dispersion as claimed in claim 1, wherein the total amount of additives is below 2% by weight.

20. A dispersion as claimed in claim 19, wherein the total amount of additives is in the range from 0.1 to 1% by weight.

21. A dispersion as claimed in claim 1, wherein one of said polymers is a polysaccharide.

22. A dispersion as claimed in claim 21, wherein the polysaccharide is a xanthan gum or a guar gum.

23. A dispersion as claimed in claim 1, wherein said one polymer is an alkylaryl polypropylene oxide.

24. A dispersion as claimed in claim 16, wherein the total amount of additives is below 2% by weight.

* * * * *

UNITED STATES PATENT AND TRADEMARK OFFICE

CERTIFICATE OF CORRECTION

PATENT NO. : 4,599,089

DATED : July 8, 1986

INVENTOR(S) : STIGSSON et al.

It is certified that error appears in the above-identified patent and that said Letters Patent are hereby corrected as shown below:

Column 15, lines 37 to 43, "5. A...quaternary amine." should read --5. A dispersion as claimed in Claim 3, wherein said one polymer is cationic. 6. A dispersion as claimed in Claim 5, wherein said one polymer contains at least one of the groups including amine, alkylamine and quaternary amine.--

Signed and Sealed this

Twenty-third Day of December, 1986

*Attest:*

DONALD J. QUIGG

*Attesting Officer* *Commissioner of Patents and Trademarks*